US010184733B2

(12) United States Patent
Tominaga et al.

(10) Patent No.: US 10,184,733 B2
(45) Date of Patent: Jan. 22, 2019

(54) HEAT EXCHANGER

(71) Applicant: Toyota Jidosha Kabushiki Kaisha, Toyota-shi (JP)

(72) Inventors: Satoshi Tominaga, Susono (JP); Daisuke Tokozakura, Susono (JP); Takahiro Shiina, Numazu (JP); Kazuya Arakawa, Hujinomiya (JP); Hitoshi Takayama, Nagakute (JP); Keisuke Ichige, Nagakute (JP); Masanori Iritani, Nagakute (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 263 days.

(21) Appl. No.: 14/979,404

(22) Filed: Dec. 27, 2015

(65) Prior Publication Data

US 2016/0223274 A1 Aug. 4, 2016

(30) Foreign Application Priority Data

Feb. 4, 2015 (JP) ..... 2015-020511

(51) Int. Cl.
*F28F 13/08* (2006.01)
*F28F 13/06* (2006.01)
(Continued)

(52) U.S. Cl.
CPC ..... *F28F 13/08* (2013.01); *F28F 3/02* (2013.01); *F28F 13/06* (2013.01); *F28F 27/02* (2013.01);
(Continued)

(58) Field of Classification Search
CPC .. F28F 13/08; F28F 13/06; F28F 13/04; F28F 13/042; F28F 27/02
(Continued)

(56) References Cited

U.S. PATENT DOCUMENTS 5,871,043 A * 2/1999 Osakabe ..... F28D 15/0233 165/104.21
6,843,211 B2 * 1/2005 Iwasaki ..... B60H 1/02 123/41.31
(Continued)

FOREIGN PATENT DOCUMENTS

JP 11-83349 3/1999
JP 2003-262489 9/2003

OTHER PUBLICATIONS

English translation Atsushi (JPH1183349) (note the foriegn application was on applicants May 8, 2017 IDS).*

*Primary Examiner* — Jianying Atkisson
*Assistant Examiner* — Joel Attey
(74) *Attorney, Agent, or Firm* — Oblon, McClelland, Maier & Neustadt, L.L.P.

(57) ABSTRACT

A heat exchanger includes: a first flow passage where first liquid flows; a second flow passage where second liquid flows; and a heat exchanger main body configured to exchange heat between the first liquid and the second liquid. The heat exchanger main body includes a cross-sectional area adjuster configured to change a flow passage cross-sectional area of at least one of the first flow passage and the second flow passage by thermal deformation. The cross-sectional area adjuster adjusts a value of the flow passage cross-sectional area in a low temperature range to be larger than a value of the flow passage cross-sectional area in a high temperature range.

6 Claims, 8 Drawing Sheets

(51) Int. Cl.

| | |
|---|---|
| ***F28F 3/02*** | (2006.01) |
| ***F28F 27/02*** | (2006.01) |
| *F28F 13/04* | (2006.01) |
| *F28F 21/06* | (2006.01) |
| *F28D 21/00* | (2006.01) |

(52) U.S. Cl.
CPC ..... *F28D 2021/0089* (2013.01); *F28F 13/04* (2013.01); *F28F 21/067* (2013.01); *F28F 2250/06* (2013.01)

(58) Field of Classification Search
USPC ..... 165/103
See application file for complete search history.

(56) References Cited

U.S. PATENT DOCUMENTS

| | | | | |
|---|---|---|---|---|
| 7,093,650 | B2 * | 8/2006 | Hashimoto | F16L 9/006 165/133 |
| 2009/0025915 | A1 * | 1/2009 | Qvist | F28D 7/1653 165/149 |

* cited by examiner

X-X CROSS-SECTION

X-X CROSS-SECTION

HEAT EXCHANGER

CROSS-REFERENCE TO RELATED APPLICATION(S)

The present application claims priority to and incorporates by reference the entire contents of Japanese Patent Application No. 2015-020511, filed on Feb. 4, 2015.

BACKGROUND OF THE INVENTION

1. Field of the Invention

The present invention relates to a heat exchanger.

2. Description of the Related Art

Conventionally, there is a heat exchanger to exchange heat between different fluids. For example, Japanese Laid-open Patent Publication No. 2003-262489 discloses a technology of a plate type heat exchanger including: a plurality of heat transmission plates which are stacked and have clearances between staked layers; and a partition wall interposed between the clearances, having inlets and outlets opened at edge portions of the heat transmission plates, and configured to form separate interlayer flow passages extending in the surface direction of the heat transmission plates. In this heat exchanger, the fluids having different temperatures alternately flow in the respective clearances adjacent to each other in the stacking direction while interposing the heat transmission plates, thereby exchanging heat via the heat transmission plates.

In the plate type heat exchanger disclosed in Japanese Laid-open Patent Publication No. 2003-262489, at least one of the interlayer flow passages functions a flow control flow passage having a flow control unit to control flow of the fluids that flows in from the inlets and flows out from the outlets. According to this plate type heat exchanger, heat exchange is performed by two kinds of fluids having different temperatures, such as a low-temperature reformed gas and a reform flue gas, via the heat transmission plates.

In the case where fluids to perform heat exchange is liquid in a heat exchanger, pressure loss is likely to fluctuate in response to temperature change. In the case of increasing a heat exchange amount in a heat exchanger in a high temperature range where kinetic viscosity of the liquid becomes low, it is advantageous to increase a contact area with the fluids by disposing a member such as a fin on a flow passage of the liquid. However, this kind of member increases the pressure loss in a low temperature range where kinetic viscosity of the liquid becomes high. When a flow speed of the liquid is reduced by such increase of the pressure loss, decrease of the heat exchange amount may be caused. In the heat exchanger that exchanges heat with the liquid, it is demanded to achieve both increase of the heat exchange amount and reduction of the pressure loss.

There is a need for providing a heat exchanger capable of achieving both increase of the heat exchange amount and reduction of the pressure loss.

SUMMARY OF THE INVENTION

It is an object of the present invention to at least partially solve the problems in the conventional technology.

A heat exchanger of the disclosure includes: a first flow passage where first liquid flows; a second flow passage where second liquid flows; and a heat exchanger main body configured to exchange heat between the first liquid and the second liquid. The heat exchanger main body includes a cross-sectional area adjuster configured to change a flow passage cross-sectional area of at least one of the first flow passage and the second flow passage by thermal deformation. The cross-sectional area adjuster adjusts a value of the flow passage cross-sectional area in a low temperature range to be larger than a value of the flow passage cross-sectional area in a high temperature range.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A heat exchanger according to an embodiment of the present invention will be described below in detail with reference to the drawings. Note that the present invention is not limited by the embodiment. Further, components in the following embodiment may include those readily conceivable by men skilled in the art or those substantially equivalent.

Embodiment

Figure 1:
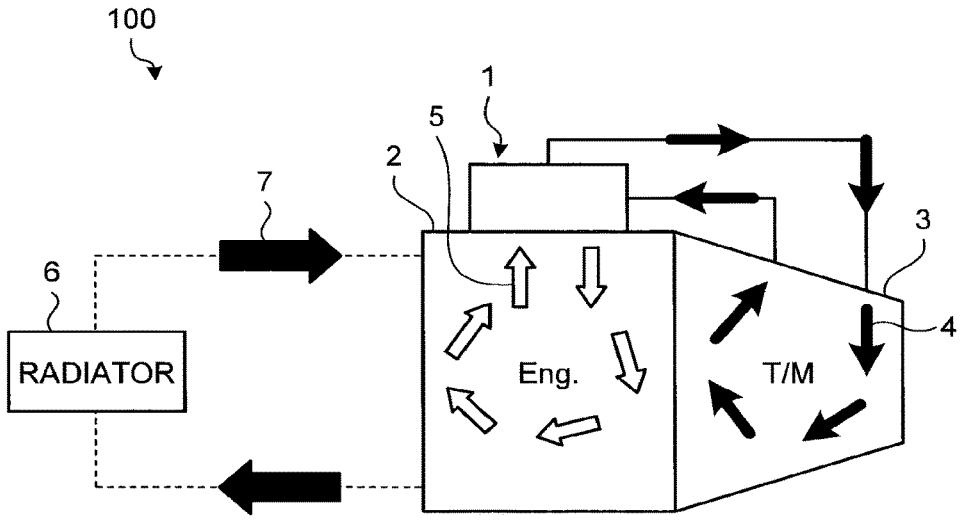
FIG. 1 is a diagram illustrating a main portion of a vehicle according to an embodiment.
Figure 2:
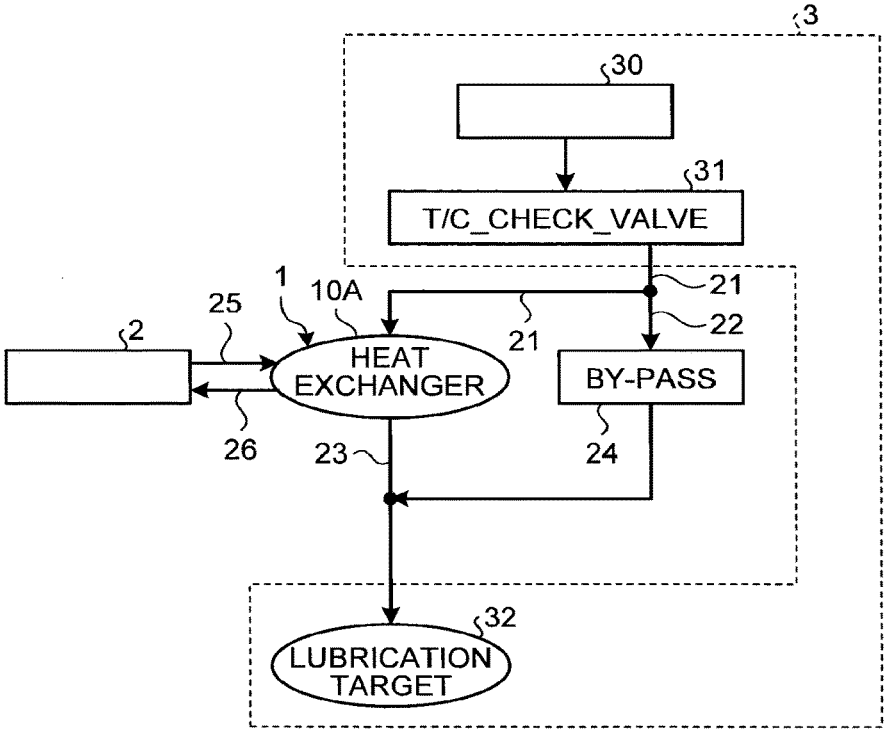
FIG. 2 is a diagram illustrating flow passages connected to a heat exchanger according to the embodiment.

An embodiment will be described with reference to FIGS. 1 to 11. The present embodiment relates to a heat exchanger. FIG. 1 is a diagram illustrating a main portion of a vehicle according to the embodiment, and FIG. 2 is a diagram illustrating flow passages connected to the heat exchanger according to the embodiment.

As illustrated in FIG. 1, a vehicle 100 includes a heat exchanger 1, an engine 2, a transmission 3, and a radiator 6. The engine 2 converts combustion energy of fuel to rotary motion. Rotation of the engine 2 is transmitted to a drive wheel after shifting gears by the transmission (T/M) 3. The engine 2 of the present embodiment is an internal combustion engine. An engine oil 5 lubricates and cools respective portions of the engine 2. The engine oil 5 is fed by an engine oil pump, and circulates inside the engine 2. Cooling water 7 cools the respective portions of the engine 2 such as a cylinder. The cooling water 7 is fed by a water pump, and circulates inside the engine 2. When temperature of the cooling water 7 reaches a predetermined temperature or higher, the cooling water 7 is fed to the radiator 6. The radiator 6 cools the cooling water 7 by exchanging heat with the atmosphere.

The transmission 3 of the present embodiment is an automatic transmission. A transmission oil 4 lubricates and cools respective portions of the transmission 3. The transmission oil 4 is fed by a T/M oil pump, and circulates inside the transmission 3.

The heat exchanger 1 of the present embodiment is a vehicle heat exchanger that exchanges heat with the transmission oil 4 and the engine oil 5. According to the present embodiment, the transmission oil 4 is a first liquid flowing in the heat exchanger 1, and the engine oil 5 is a second liquid flowing in the heat exchanger 1. In a warm-up time such as cold start time, a temperature of the engine oil 5 (hereinafter simply referred to as "engine oil temperature") is high compared to a temperature of the transmission oil 4 (hereinafter simply referred to as "T/M oil temperature"). The T/M oil temperature increase is accelerated by transferring heat to the transmission oil 4 from the engine oil 5 by the heat exchanger 1, compared to the case where heat is not exchanged by the heat exchanger 1. Such increase of the T/M oil temperature quickly lowers kinetic viscosity ν [$mm^2$/sec] of the transmission oil 4, and reduces dragging loss in the respective portions of the transmission 3. Therefore, in the vehicle 100 of the present embodiment, loss in the vehicle 100 is reduced by exchanging heat at the heat exchanger 1.

As illustrated in FIG. 2, a first inlet flow passage 21 and a first outlet flow passage 23 are connected to the heat exchanger 1. The first inlet flow passage 21 and the first outlet flow passage 23 are flow passages for the transmission oil 4. The first inlet flow passage 21 is connected to a hydraulic control system 30 of the transmission 3 via a check valve 31. The hydraulic control system 30 supplies hydraulic pressure to an engaging device such as a speed change clutch and a brake of the transmission 3, and a lock-up clutch. The check valve 31 is opened when a differential pressure between a pressure on the hydraulic control system 30 side and a pressure on the first inlet flow passage 21 side reaches a predetermined pressure or more.

An external bypass flow passage 22 is an oil passage to flow the transmission oil 4 by bypassing the heat exchanger 1. The external bypass flow passage 22 allows communication between the first inlet flow passage 21 and the first outlet flow passage 23. A bypass valve 24 is provided at the external bypass flow passage 22. The bypass valve 24 is a switch valve to open and close the bypass flow passage. The bypass valve 24 is opened when a differential pressure between the pressure on the first inlet flow passage 21 side and a pressure on the first outlet flow passage 23 side reaches a predetermined pressure or more. The first outlet flow passage 23 is connected to a lubrication target 32 of the transmission 3. The lubrication target 32 is, for example, a meshed portion of gears of the transmission 3, typically, a meshed portion of gears of a planetary gear mechanism and a meshed portion of differential gears. The lubrication target 32 includes the engaging devices such as the clutch and the brake. The transmission oil 4 flowing out from the heat exchanger 1 is fed to the lubrication target 32 via the first outlet flow passage 23.

As second inlet flow passage 25 and a second outlet flow passage 26 are passages for the engine oil 5. The second inlet flow passage 25 introduces the engine oil 5 from the engine 2 to the heat exchanger 1. The second outlet flow passage 26 introduces the engine oil 5 subjected to heat exchange from the heat exchanger 1 to the engine 2.

Figure 3:
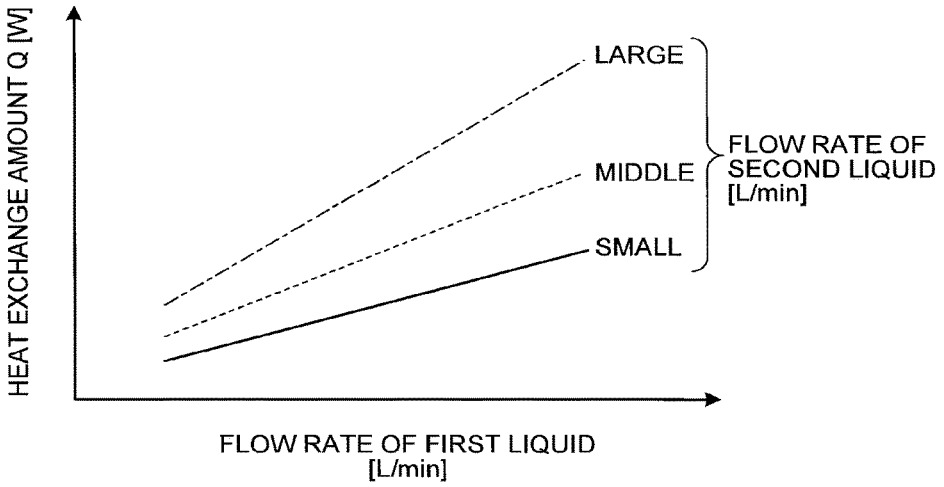
FIG. 3 is a diagram illustrating a correspondence relation between a flow rate of liquid and a heat exchange amount.

As illustrated in FIG. 3, the heat exchange amount Q [W] in the heat exchanger 1 is changed in response to a flow rate of the transmission oil 4 [L/min] and a flow rate of the engine oil 5 [L/min]. In FIG. 3, a horizontal axis represents the flow rate of the transmission oil 4 (first liquid) flowing in a first flow passage 11, and a vertical axis represents the heat exchange amount Q in the heat exchanger 1. In FIG. 3, a solid line represents a heat exchange amount Q in the case where the flow rate of the engine oil 5 (second liquid) is small, a dotted line represents a heat exchange amount Q in the case where the flow rate of the engine oil 5 is intermediate, and a dot-and-dash line represents a heat exchange amount Q in the case where the flow rate of the engine oil 5 is large. As illustrated in FIG. 3, the more the flow rate of the transmission oil 4 is increased, the more the heat exchange amount Q is increased. Further, the more the flow rate of the engine oil 5 is increased, the more heat exchange amount Q is increased.

Here, in the case where the T/M oil temperature and the engine oil temperature are low, the kinetic viscosity ν of the oils 4, 5 is higher than in the case where the mentioned temperatures are high. Due to this, in the case where the oil temperature is low, the pressure loss inside the heat exchanger 1 is increased and the flow speeds of oils 4, 5 are reduced compared to the case where the oil temperature is high. As a result, there may be a problem in which the heat exchange amount Q is reduced in the case where the oil temperature is low, and increase of the T/M oil temperature is decelerated.

The heat exchanger 1 according to the present embodiment has a temperature-sensitive structure as described below, in which in the case where the oil temperature is low, a flow passage cross-sectional area of the flow passage where the oils 4, 5 flow is increased larger than that in the case where the oil temperature is high. Therefore, the heat exchanger 1 of the present embodiment can accelerate increase of the T/M oil temperature while reducing the pressure loss at the time of low temperature.

Figure 4:
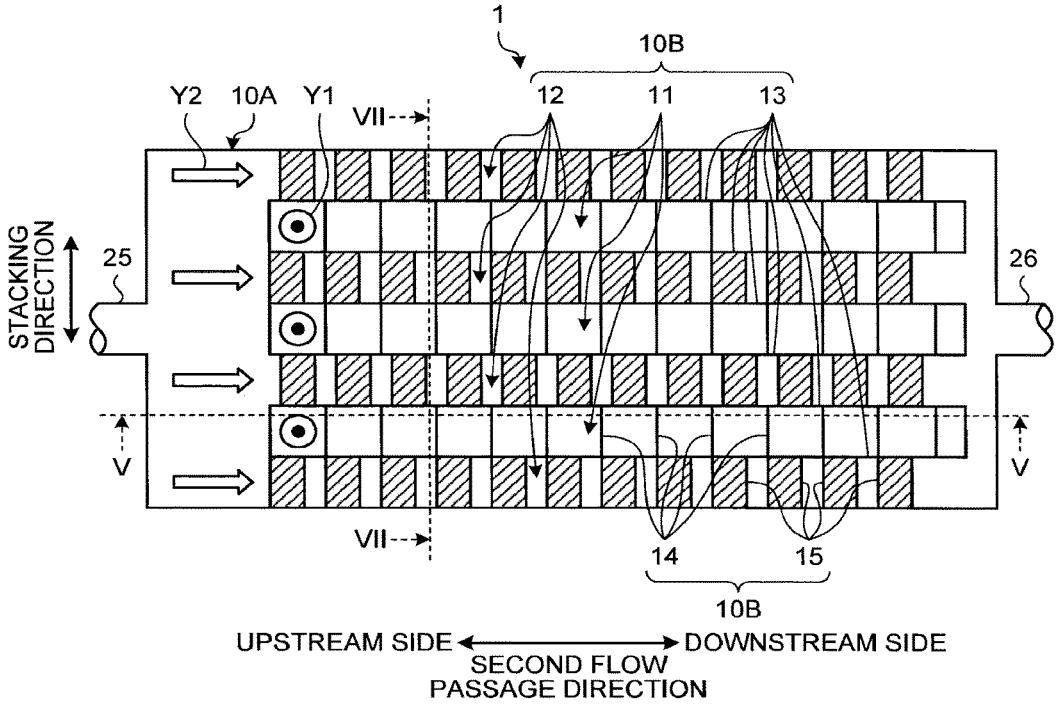
FIG. 4 is a schematic configuration diagram of the heat exchanger according to the embodiment.

As illustrated in FIG. 4, the heat exchanger 1 includes a case 10A and heat exchanger main body 10B. The case 10A is an outer shell member of the heat exchanger 1. The case 10A is connected to the second inlet flow passage 25 and the second outlet flow passage 26. Further, as illustrated in FIG. 2, the case 10A is connected to the first inlet flow passage 21 and the first outlet flow passage 23. As illustrated in FIG. 4, the heat exchanger main body 10B is disposed inside the case 10A. The heat exchanger main body 10B includes the first flow passage 11, a second flow passage 12, a separator 13, a first fin 14, and a second fin 15. The first flow passage 11 is a passage where the transmission oil 4 flows. The second flow passage 12 is a passage where the engine oil 5 flows. The heat exchanger main body 10B exchanges heat between the transmission oil 4 and the engine oil 5.

In FIG. 4, the flow passage direction of the first flow passage 11 is a direction orthogonal to the drawing paper surface. In the following description, the flow passage direction of the first flow passage 11 will be simply referred to as "first flow passage direction". The first flow passage direction is a direction connecting an inlet side of the first flow passage 11 (side connected to the first inlet flow passage 21) to an outlet side (side connected to the first outlet flow passage 23). In FIG. 4, the transmission oil 4 flows in the first flow passage 11 from a back side to a front side in the direction orthogonal to the drawing paper as indicated by a reference sign Y1.

In FIG. 4, a flow passage direction of the second flow passage 12 is a horizontal direction. In the following, the flow passage direction of the second flow passage 12 will be simply referred to as "second flow passage direction". The second flow passage direction is a direction connecting an inlet side of the second flow passage 12 (side connected to the second inlet flow passage 25) to an outlet side (side connected to the second outlet flow passage 26). In FIG. 4, the engine oil 5 flows in the second flow passage 12 from the left side to the right side of FIG. 4 as indicated by a reference sign Y2.

In the following description, the direction orthogonal to the first flow passage direction and the second flow passage direction respectively will be referred to as a "stacking direction". The heat exchanger main body 10B has a stacking structure where the first flow passage 11 and the second flow passage 12 are alternately arranged in the stacking direction. The separator 13 is a partitioning member to separate the first flow passage 11 from the second flow passage 12. The separator 13 has appropriate heat conductivity, and exchanges heat between the transmission oil 4 and engine oil 5. The separator 13 is a plate-like member orthogonal to the stacking direction.

As illustrated in FIG. 4, the engine oil 5 flowing into the case 10A from the second inlet flow passage 25 flows in the second flow passage 12 of each layer, and exchanges heat with the transmission oil 4 in the first flow passage 11 via the separator 13. The engine oil 5 subjected to heat change flows out to the second outlet flow passage 26 from the second flow passage 12 of each layer. In the same manner, the transmission oil 4 flowing into the case 10A from the first inlet flow passage 21 flows in the first flow passage 11 of each layer, and exchanges heat with the engine oil 5 in the second flow passage 12 via the separator 13. The transmission oil 4 subjected to heat exchange flows out to the first outlet flow passage 23 from the first flow passage 11 of each layer.

The first fin 14 is arranged in the first flow passage 11. The first fin 14 has a plate-like shape. A thickness direction of the first fin 14 coincides with the second flow passage direction. In other words, both surfaces of the first fin 14 are orthogonal to the second flow passage direction. The first fin 14 is connected to each of a separator 13 on one side and a separator 13 on the other side. These separators 13 face each other in the stacking direction. The first fin 14 transfers heat between the transmission oil 4 and the separator 13. Each first flow passage 11 is provided with multiple rows of the first fins 14. The multiple rows of the first fins 14 are arranged at a predetermined interval in the second flow passage directions.

A second fin 15 is arranged in the second flow passage 12. The second fin 15 has a rectangular plate-like shape. A thickness direction of the second fin 15 coincides with the first flow passage direction. In other words, both surfaces of the second fin 15 are orthogonal to the first flow passage direction. The second fin 15 is connected to each of a separator 13 on one side and a separator 13 on the other side. The separators 13 face each other in the stacking direction. The second fin 15 transfers heat between the engine oil 5 and the separator 13. A plurality of second fins 15 is arranged at a predetermined interval in the second flow passage direction. Further, multiple rows of the second fins 15 are arranged in the first flow passage direction.

Figure 5:
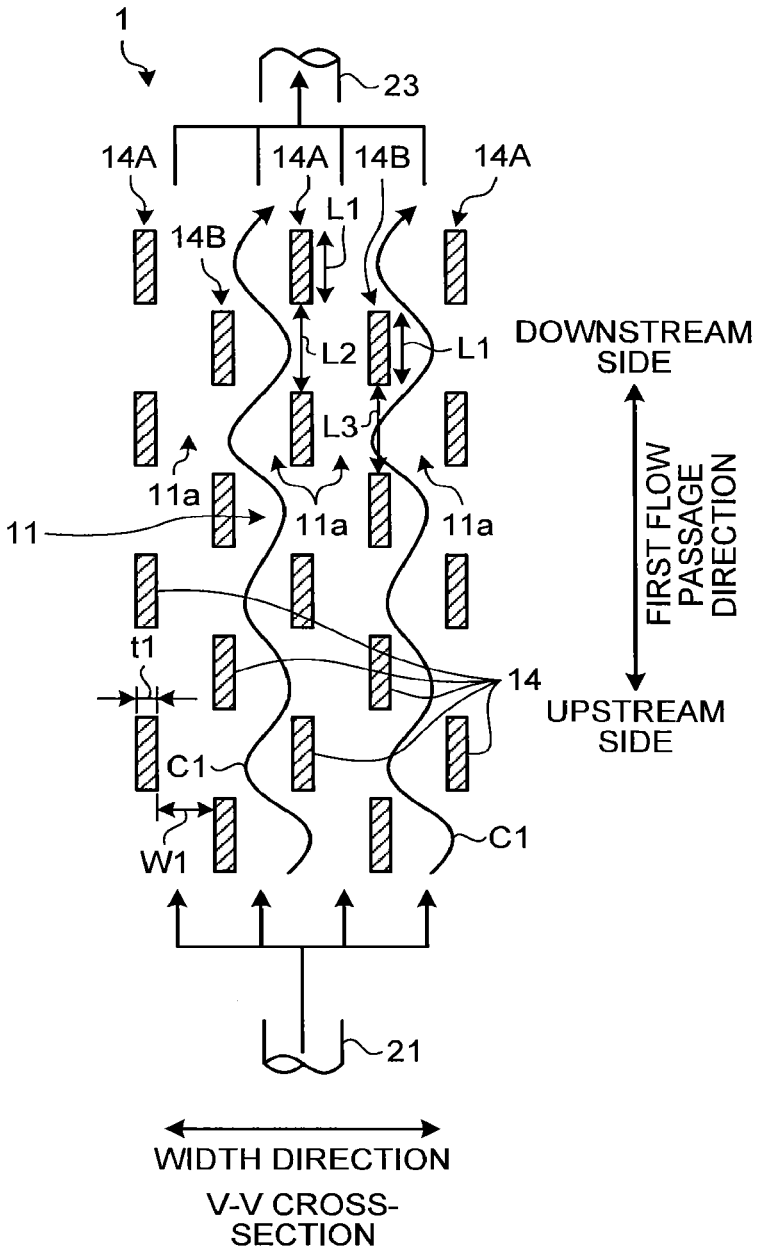
FIG. 5 is a cross-sectional view illustrating a first flow passage in a low temperature range.

FIG. 5 is a cross-sectional view taken along a V-V line in FIG. 4. In the cross-section illustrated in FIG. 5, a direction orthogonal to the first flow passage direction will be referred to as a "width direction". The width direction is a direction orthogonal to the first flow passage direction and the stacking direction respectively. As illustrated in FIG. 5, the first fins 14 of a first row 14A and the first fins 14 of a second row 14B adjacent thereto are arranged in different positions of the first flow passage direction. According to the heat exchanger 1 of the present embodiment, an interval L2 between the first fins 14 in the first flow passage direction is larger than a length L1 of the first fin 14 in the first row 14A. Further, an interval L3 between the first fins 14 in the first flow passage direction is larger than the length L1 of the first fin 14 in the second row 14B. According to the present embodiment, the two intervals L2 and L3 are equal. The first fins 14 of the first row 14A and the first fins 14 of the second row 14B are arranged in a manner not overlapping each other or slightly overlapping each other in the view from the width direction. In other words, the first fins 14 in the first row 14A and the first fins 14 in the second row 14B are alternately arranged along the first flow passage direction.

A plurality of passages 11*a* exists in the first flow passage 11. The passage 11*a* is a clearance in the width direction between the first row 14A and the second row 14B. In the passage 11*a*, there is no obstacle along the first flow passage direction. Therefore, flow C1 of the transmission oil 4 in the first flow passage direction is generated in each passage 11*a*.

Figure 6:
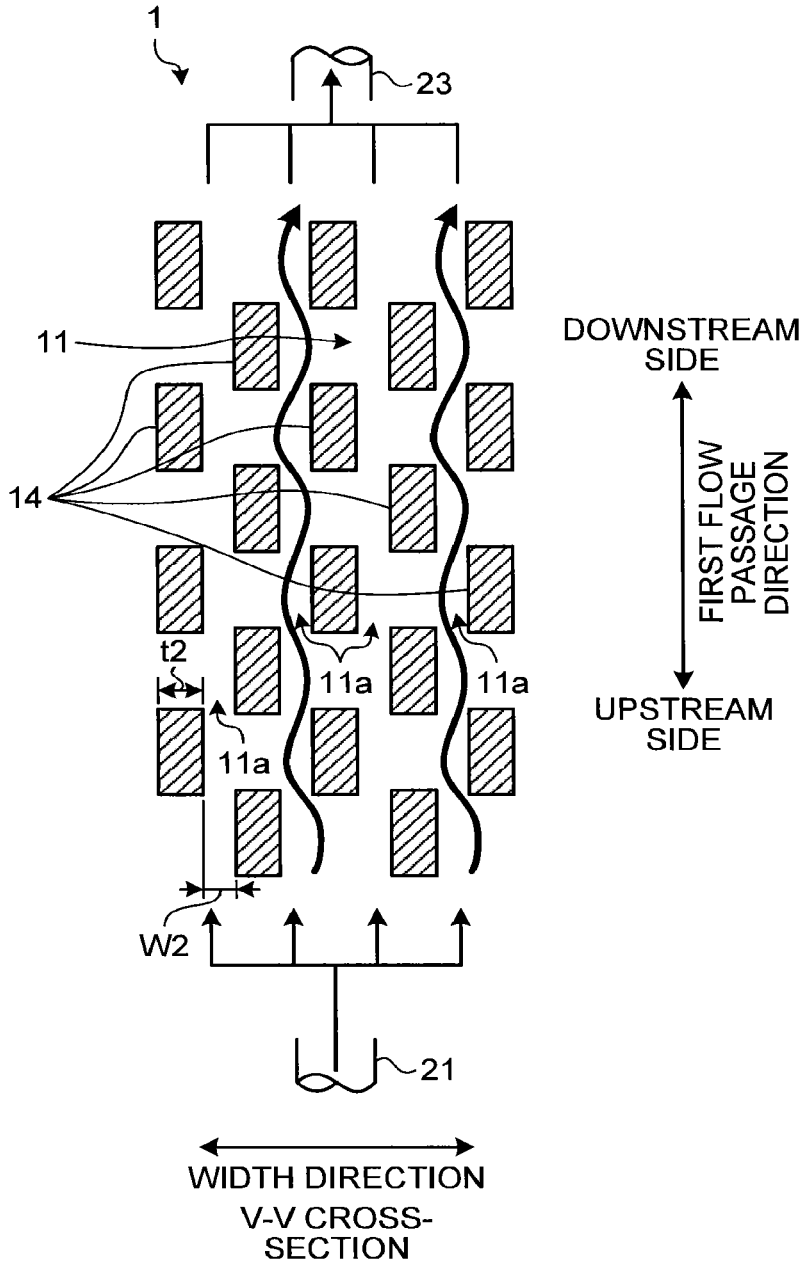
FIG. 6 is a cross-sectional view illustrating the first flow passage in a high temperature range.

The first fin 14 of the present embodiment has a function as a cross-sectional area adjuster that changes a flow passage cross-sectional area of the first flow passage 11 by performing thermal deformation. The first fin 14 expands in response to temperature increase of the first fin 14. FIG. 5 illustrates the first fin 14 in the case where the temperature of the first fin 14 is in a low temperature range. Here, for example, the low temperature range is a low temperature region within a temperature range of the T/M oil temperature assumed in the case of using the vehicle 100 under general environment. In the present embodiment, a representative temperature of the low temperature range is set at 40° C. FIG. 6 illustrates the first fin 14 in the case where the temperature of the first fin 14 is in a high temperature range. The high temperature range is, for example, a high temperature region within a temperature range of the T/M oil temperature assumed in the case of using the vehicle 100 under the general environment. In the present embodiment, a representative temperature of the high temperature range is set at 100° C.

As illustrated in FIG. 6, the first fin 14 having the temperature in the high temperature range expands with respect to the first fin 14 having the temperature in the low temperature range illustrated in FIG. 5. A thickness t2 of the first fin 14 in the high temperature range is larger than a thickness t1 of the first fin 14 in the low temperature range. Due to this, a width W2 of the passage 11*a* in the high temperature range is smaller than a width W1 of the passage 11*a* in the low temperature range. Therefore, a flow passage cross-sectional area A2 of the first flow passage 11 in the high temperature range is smaller than a flow passage cross-sectional area A1 of the first flow passage 11 in the low temperature range. Since the width W1 of the passage 11*a* in the low temperature range is large, shear stress applied to the transmission oil 4 is reduced and the pressure loss is reduced. The separator 13 of the present embodiment supports the first fin 14 in a manner allowing expansion of the first fin 14 in the width direction. For example, one end out of both ends in the width direction of the first fin 14 is fixed to the separator 13, and the other end is not fixed to the separator 13. With this structure, when the first fin 14 expands, the other end can be relatively displaced in the width direction with respect to the separator 13. Therefore, expansion of the first fin 14 in the width direction is not hindered by the separator 13.

According to the heat exchanger 1 of the present embodiment, the heat exchange amount can be increased as described below. In the case where the temperature of the transmission oil 4 is low, the kinetic viscosity ν of the transmission oil 4 has a high value, and the pressure loss in the first flow passage 11 tends to be increased. The first fin 14 and the separator 13 of the present embodiment increase the flow passage cross-sectional area A1 in the low temperature range larger than the flow passage cross-sectional area A2 in the high temperature range of the first flow passage 11. This reduces the pressure loss of the first flow passage 11 in the low temperature range, and increases the flow speed and the flow rate of the first flow passage 11. Further, in the heat exchanger 1 of the present embodiment, a thickness t, a linear expansion coefficient, etc. of the first fin 14 are set so as not to open the bypass valve 24 at a lower limit temperature of the T/M oil temperature assumed in the case of using the vehicle 100 under the general environment. Therefore, the flow rate and the heat exchange amount of the first flow passage 11 in the low temperature range can be maximized.

Further, in the heat exchanger 1 of the present embodiment, the first fin 14 expands by performing thermal deformation in response to temperature increase, thereby reducing the flow passage cross-sectional area of the first flow passage 11. Therefore, the first fin 14 increases a speed of the transmission oil 4 in the first flow passage 11 in response to the temperature increase, thereby increasing the heat exchange amount Q of the heat exchanger 1. The kinetic viscosity ν of the transmission oil 4 is decreased in response to the temperature increase. Therefore, the pressure loss is hardly increased even though the first fin 14 reduces the flow passage cross-sectional area of the first flow passage 11. According to the present embodiment, the linear expansion coefficient and the like of the first fin 14 are set so as not to open the bypass valve 24 at an upper limit temperature of the T/M oil temperature assumed in the case of using the vehicle 100 under the general environment.

Preferable characteristics of the first fin 14 of the present embodiment will be described. The linear expansion coefficient of the first fin 14 is, for example, larger than a linear expansion coefficient of aluminum generally used as a material of a fin of a heat exchanger. As exemplary materials of the first fin 14, mercury, polyethylene, etc. may be used. For example, the first fin 14 may be formed of alloy containing mercury, formed of polyethylene, or formed of resin containing polyethylene. Meanwhile, mercury and polyethylene may be used as materials of the second fin 15 and the separator 13. As the materials of the first fin 14, second fin 15, and separator 13, the material having large heat conductivity is preferable.

Meanwhile, in the heat exchanger 1 of the present embodiment, the second fin 15 expands in response to temperature increase in the second flow passage 12, thereby reducing the flow passage cross-sectional area in the second flow passage 12. Therefore, a flow passage cross-sectional area A4 of the second flow passage 12 in the high temperature range becomes smaller than a flow passage cross-sectional area A3 of the second flow passage 12 in the low temperature range. Due to this, the pressure loss of the second flow passage 12 in the low temperature range is reduced, and the flow speed of the engine oil 5 in the low temperature range is increased. Further, the flow speed of the engine oil 5 in the high temperature range is increased, and the heat exchange amount Q is increased.

Figure 7:
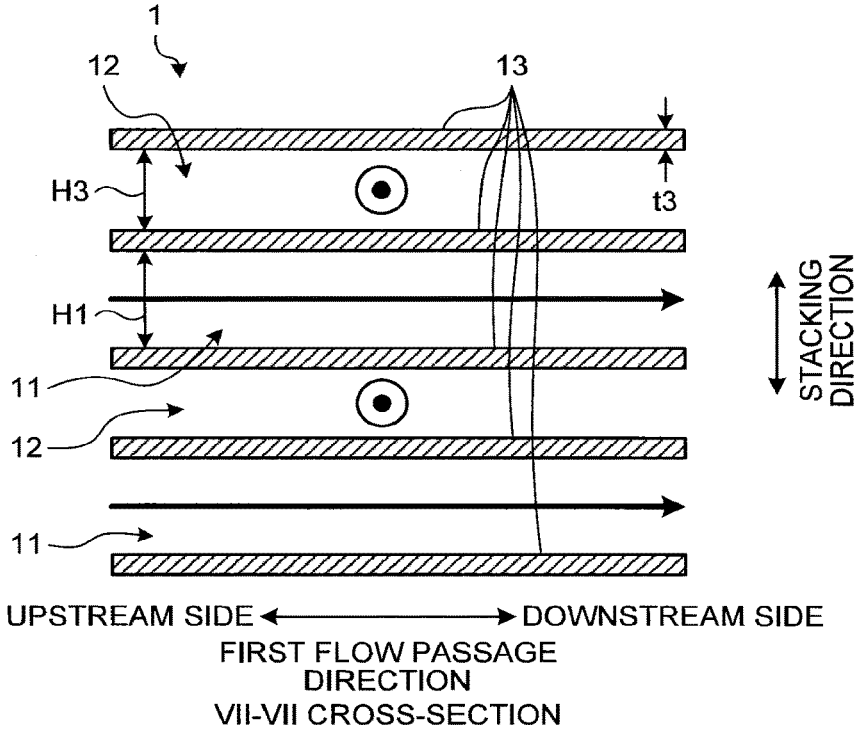
FIG. 7 is a cross-sectional view illustrating heights of the first flow passage and a second flow passage in the low temperature range.
Figure 8:
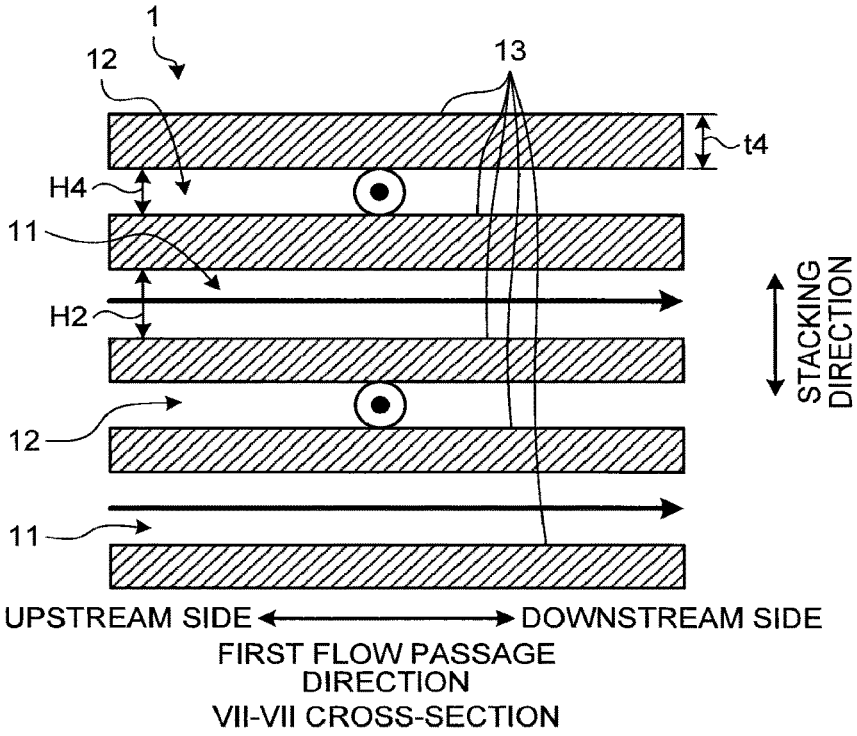
FIG. 8 is a cross-sectional view illustrating heights of the first flow passage and the second flow passage in the high temperature range.

Further, according to the heat exchanger 1 of the present embodiment, not only the fins 14, 15 but also the separator 13 have the function as the cross-sectional area adjuster that changes the flow passage cross-sectional area in the first flow passage 11 by performing thermal deformation. FIG. 7 is a diagram illustrating a cross-section taken along a line VII-VII in FIG. 4. In FIG. 7, the separator 13 in the low temperature range is illustrated. In the present embodiment, a width in the stacking direction in the first flow passage 11 and the second flow passage 12 are referred to as "height". In the low temperature range, the height of the first flow passage 11 is defined as H1, and the height of the second flow passage 12 is defined as H3. As illustrated in FIG. 8, the separator 13 having the temperature in the high temperature range expands with respect to the separator 13 having the temperature in the low temperature range illustrated in FIG. 7. A thickness t4 of the separator 13 in the high temperature range is larger than a thickness t3 of the separator 13 in the low temperature range. Due to this, the height H2 of the first flow passage 11 in the high temperature range becomes shorter than the height H1 of the first flow passage 11 in the low temperature range. Therefore, the flow passage cross-sectional area A2 of the first flow passage 11 in the high temperature range becomes smaller than the flow passage cross-sectional area A1 of the first flow passage 11 in the low temperature range.

Further, a height H4 of the second flow passage 12 in the high temperature range is shorter than a height H3 of the second flow passage 12 in the low temperature range. Therefore, the flow passage cross-sectional area A4 of the second flow passage 12 in the high temperature range becomes smaller than the flow passage cross-sectional area A3 of the second flow passage 12 in the low temperature range. Since the heights H1, H3 of the flow passages 11, 12 in the low temperature range are high, shear stress applied to the oils 4, 5 is reduced, thereby reducing the pressure loss in the flow passages 11, 12.

Figure 9:
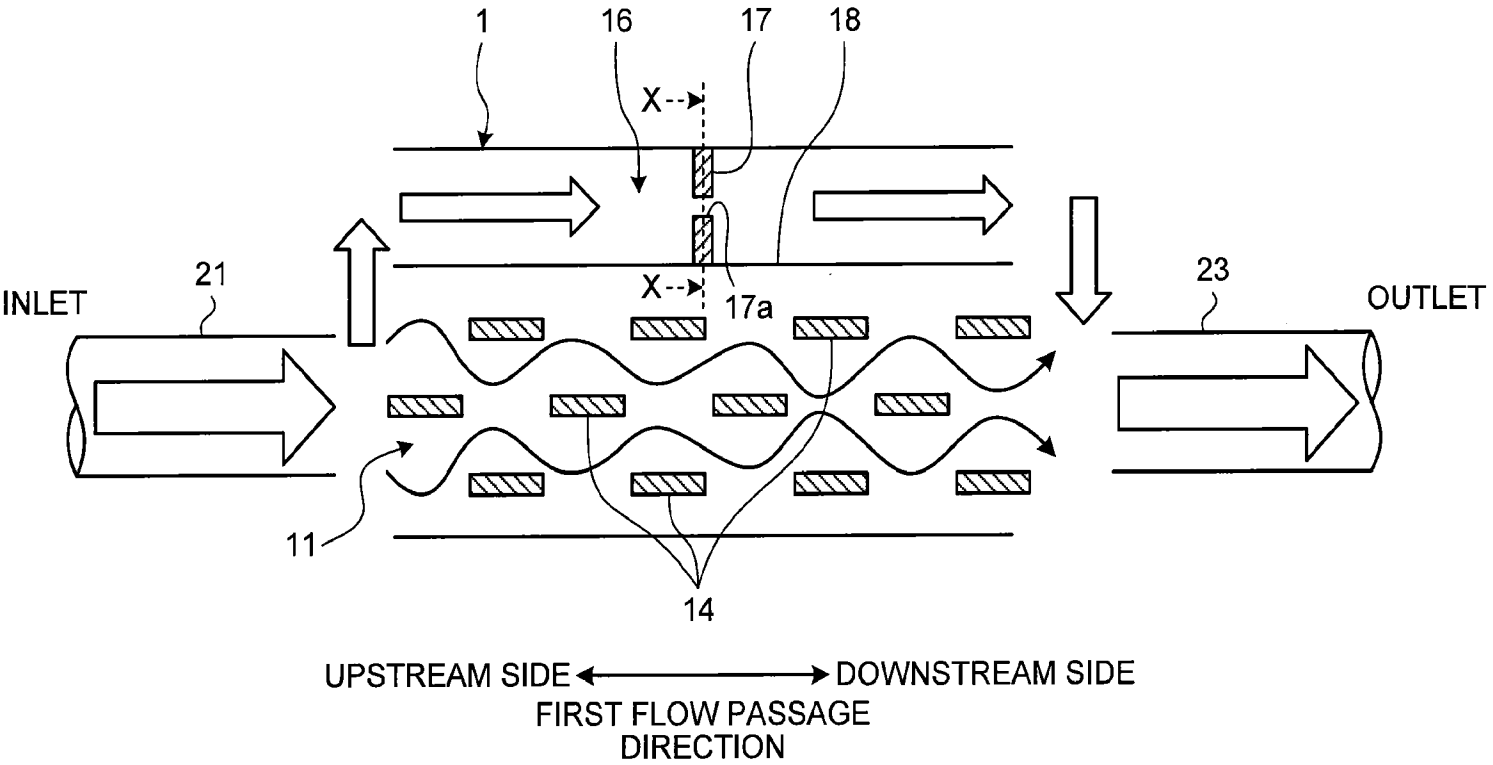
FIG. 9 is an explanatory diagram illustrating a bypass flow passage according to the embodiment.
Figure 10:
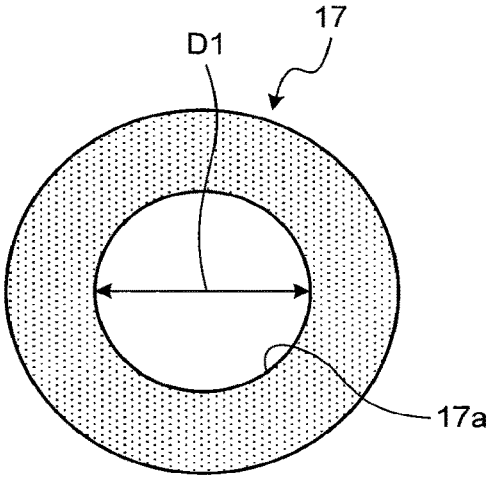
FIG. 10 is a cross-sectional view illustrating an orifice in the low temperature range.
Figure 11:
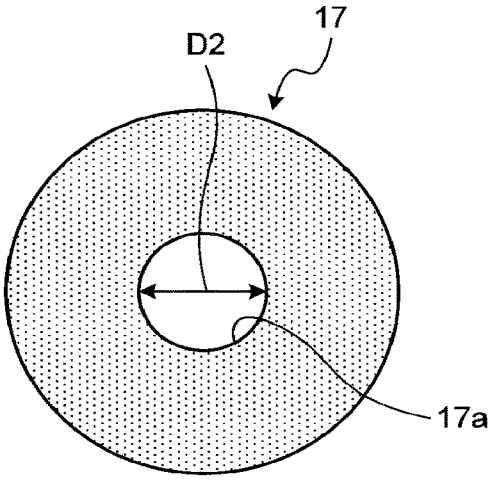
FIG. 11 is a cross-sectional view illustrating the orifice in the high temperature range.

Further, the heat exchanger 1 of the present embodiment includes a bypass flow passage 16 and an orifice 17 as described with reference to FIG. 9. The bypass flow passage 16 is a flow passage to flow the transmission oil 4 by bypassing the first flow passage 11. The bypass flow passage 16 allows communication between the first inlet flow passage 21 and the first outlet flow passage 23. The bypass flow passage 16 is disposed adjacent to the first flow passage 11, and separated from the first flow passage 11 by a partitioning member 18. The bypass flow passage 16 is provided with the orifice 17 is disposed. A flow passage cross-sectional area of the bypass flow passage 16 has a minimum value at the orifice 17. The orifice 17 has a function as a second cross-sectional area adjuster that reduces the flow passage cross-sectional area of the bypass flow passage 16 in the high temperature range smaller than the flow passage cross-sectional area of the bypass flow passage in the low temperature range. As illustrated in FIGS. 10 and 11, the orifice 17 of the present embodiment has a ring-like shape. The pressure loss in the bypass flow passage 16 is changed in accordance with an area of a hole 17*a* of the orifice 17 (flow passage cross-sectional area).

The orifice 17 changes the flow passage cross-sectional area of the bypass flow passage 16 by performing thermal deformation. The orifice 17 of the present embodiment is formed of a material having a large linear expansion coefficient same as the first fin 14 and the separator 13. FIG. 10 illustrates a shape of the orifice 17 in the case where the orifice 17 has a temperature in the low temperature range, and FIG. 11 illustrates a shape of the orifice 17 in the case where the orifice 17 has a temperature in the high temperature range.

A diameter D1 of the hole 17*a* having the temperature in the low temperature range is larger than a diameter D2 of the hole 17*a* having the temperature in the high temperature range In other words, a flow passage cross-sectional area A6 of the bypass flow passage 16 in the high temperature range is smaller than a flow passage cross-sectional area A5 of the bypass flow passage 16 in the low temperature range. In the low temperature area where the kinetic viscosity of the transmission oil 4 is high, the flow passage cross-sectional area A5 of the bypass flow passage 16 is large. Therefore, a sufficient bypass amount of the transmission oil 4 bypassing the first flow passage 11 can be secured. By this, the pressure loss in the first flow passage 11 can be suppressed from being too large. On the other hand, in the high temperature range where the kinetic viscosity of the transmission oil 4 is low, the flow passage cross-sectional area of the bypass flow passage 16 is small. Since the transmission oil 4 hardly passes through the bypass flow passage 16, a large amount of the transmission oil 4 is made to pass the first flow passage 11. As a result, the heat exchange amount Q in the heat exchanger 1 can be increased.

As described above, the heat exchanger main body 10B of the present embodiment includes the cross-sectional area adjuster that changes the flow passage cross-sectional areas of the first flow passage 11 and the second flow passage 12 by performing thermal deformation. According to the present embodiment, the first fin 14, second fin 15, and separator 13 have the function as the cross-sectional area adjuster. The first fin 14, second fin 15, and separator 13 increase the values A1, A3 of the flow passage cross-sectional areas in the low temperature range larger than the values A2, A4 of the flow passage cross-sectional areas in the high temperature range. The heat exchanger 1 of the present embodiment can suppress the pressure loss by increasing the flow passage cross-sectional areas A1, A3 of the flow passages 11, 12 in the low temperature range. Further, the heat exchanger 1 reduces the flow passage cross-sectional areas A2, A4 of the flow passages 11, 12 in the high temperature range smaller than the flow passage cross-sectional areas A1, A3 in the low temperature range, thereby increasing the flow speeds of the oils 4, 5 in the high temperature range. By increasing the flow speeds of the oils 4, 5, the amounts of the oils 4, 5 contacting the fins 14, 15 and the separator 13 and exchanging heat per unit time is increased, thereby increasing the heat exchange amount Q. Further, since the flow passage cross-sectional areas of the flow passages 11, 12 are reduced, a ratio of the oils 4, 5 contacting the fins 14, 15 and separator 13 out of the oils 4, 5 flowing in the flow passages 11, 12 is increased, thereby improving efficiency of heat exchange. Therefore, the heat exchanger 1 of the present embodiment can achieve both reduction of the pressure loss and increase of the heat exchange amount.

The heat exchanger 1 of the present embodiment further includes the bypass flow passage 16 that flows the transmission oil 4 by bypassing the first flow passage 11, and the orifice 17 (second cross-sectional area adjuster) which is disposed in the bypass flow passage 16 and reduces the flow passage cross-sectional area of the bypass flow passage 16 in the high temperature range smaller than the flow passage cross-sectional area of the bypass flow passage 16 in the low temperature range. The orifice 17 mitigates increase of the pressure loss in the first flow passage 11 at the time of low temperature, and accelerates increase of the flow rate in the first flow passage 11 at the time of high temperature. Therefore, the heat exchanger 1 of the present embodiment can achieve both increase of the heat exchange amount and reduction of pressure loss. Meanwhile, the heat exchanger 1 may further include a bypass flow passage to flow the engine oil 5 by bypassing the second flow passage 12, and a second cross-sectional area adjuster disposed in the bypass flow passage.

In the heat exchanger 1 of the present embodiment, the cross-sectional area adjuster includes the first fin 14 and the second fin 15. Preferably, at least one of the first fin 14 and the second fin 15 is formed of the material containing mercury or polyethylene. Mercury and polyethylene have the larger linear expansion coefficient compared to standard aluminum as the fin material. As a result, the flow passage cross-sectional area can be largely changed in response to temperature change of fluids.

Meanwhile, according to the cross-sectional area adjusters of the present embodiment (first fin 14, second fin 15, and separator 13), the flow passage cross-sectional areas of both the first flow passage 11 and the second flow passage 12 are changed, but not limited thereto. For example, the cross-sectional area adjuster may change the flow passage cross-sectional area of either one of the first flow passage 11 and the second flow passage 12, and may not change the other flow passage cross-sectional area of the other one. Note that the cross-sectional area adjusters included in the heat exchanger main body 10B are not limited to the fins 14, 15 and separator 13. The heat exchanger main body 10B may include a cross-sectional area adjuster different from the fins 14, 15 and separator 13.

First Modified Example of Embodiment

A first modified example of the embodiment will be described. In the first modified example, heat is exchanged between the cooling water 7 and the transmission oil 4 in the heat exchanger 1. The cooling water 7 flows in the second flow passage 12 instead of the engine oil 5 of the above-described embodiment. The cooling water 7 has a small change rate of kinetic viscosity ν relative to temperature change, compared to oil such as the transmission oil 4. A value ν1 of the kinetic viscosity of the transmission oil 4 in the low temperature range (e.g., 40° C.) is, for example, 23.6 [$mm^2$/sec], and a value ν2 of the kinetic viscosity in the high temperature range (e.g., 100° C.) is, for example, 5.4 [$mm^2$/sec]. A value ν3 of the kinetic viscosity of the cooling water 7 in the low temperature range (e.g., 40° C.) is, for example, 0.7 [$mm^2$/sec], and a value ν4 of the kinetic viscosity in the high temperature range (e.g., 100° C.) is, for example, 0.3 [$mm^2$/sec].

As for the cooling water 7, a decrease rate of the kinetic viscosity Δνw, which is a decrease rate of the value ν4 of the kinetic viscosity in the high temperature range relative to the value ν3 of the kinetic viscosity in the low temperature range, is calculated by a following expression (1). Further, as for the transmission oil 4, a decrease rate to of the kinetic viscosity of the value ν2 of the kinetic viscosity in the high temperature range relative to the value ν1 of the kinetic viscosity in the low temperature range is calculated by a following expression (2). The decrease rate of the kinetic viscosity Δνw of the cooling water 7 is smaller than the decrease rate of the kinetic viscosity Δνo of the transmission oil 4.

$$\Delta\nu w=(\nu 3-\nu 4)/\nu 3 \quad (1)$$

$$\Delta\nu o=(\nu 1-\nu 2)/\nu 1 \quad (2)$$

The heat exchanger 1 of the first modified example has a structure in which a change rate of the flow passage cross-sectional area is varied in response to the decrease rate of the kinetic viscosity Δν. According to the first modified example, same as the above-described embodiment, the second fin 15 and the separator 13 change the flow passage cross-sectional area of the second flow passage 12. The second fin 15 and the separator 13 reduce the flow passage cross-sectional area A4 of the second flow passage 12 in the high temperature range smaller than the flow passage cross-sectional area A3 in the low temperature range. As for the second flow passage 12, a decrease rate of cross-sectional area ΔAw, which is the decrease rate of the flow passage cross-sectional area A4 in the high temperature range relative to the flow passage cross-sectional area A3 in the low temperature range, is calculated by a following expression (3).

$$\Delta Aw=(A3-A4)/A3 \quad (3)$$

Same as the above-described embodiment, the first fin 14 and the separator 13 change the flow passage cross-sectional area of the first flow passage 11. The first fin 14 and the separator 13 reduce the flow passage cross-sectional area A2 of the first flow passage 11 in the high temperature range smaller than the flow passage cross-sectional area A1 of the first flow passage 11 in the low temperature range. As for the first flow passage 11, a decrease rate of the cross-sectional area ΔAo, which is the decrease rate of the flow passage cross-sectional area A2 in the high temperature range relative to the flow passage cross-sectional area A1 in the low temperature range, is calculated by a following expression (4).

$$\Delta Ao=(A1-A2)/A1 \quad (4)$$

In the heat exchanger 1 of the first modified example, the decrease rate of the cross-sectional area ΔAo of the first flow passage 11 is larger than the decrease rate of the cross-sectional area ΔAw of the second flow passage 12. In other words, compared to the second flow passage 12, a decrease amount of the flow passage cross-sectional area is larger in the first flow passage 11 in the case of having the same temperature increase. Thus, as a means to increase the decrease rate of the cross-sectional area ΔAo of the first flow passage 11 larger than the decrease rate of the cross-sectional area ΔAw of the second flow passage 12, the linear expansion coefficient of the first fin 14 is larger than the linear expansion coefficient of the second fin 15 in the present modified example. According to the present modified example, the material of the first fin 14 contains mercury or polyethylene same as the above-described embodiment, and the material of the second fin 15 is aluminum.

In the heat exchanger 1 of the first modified example, the flow passage cross-sectional area of the first flow passage 11 is largely changed relative to the transmission oil 4 having a large change rate of the kinetic viscosity ν in response to temperature change. Therefore, the heat exchanger 1 of the first modified example can increase the flow speed of the transmission oil 4 by suitably reducing the pressure loss in the low temperature range of the first flow passage 11. Further, the heat exchanger 1 of the first modified example can increase the flow speed of the transmission oil 4 by reducing the flow passage cross-sectional area A2 in the high temperature range of the first flow passage 11.

Figure 12:
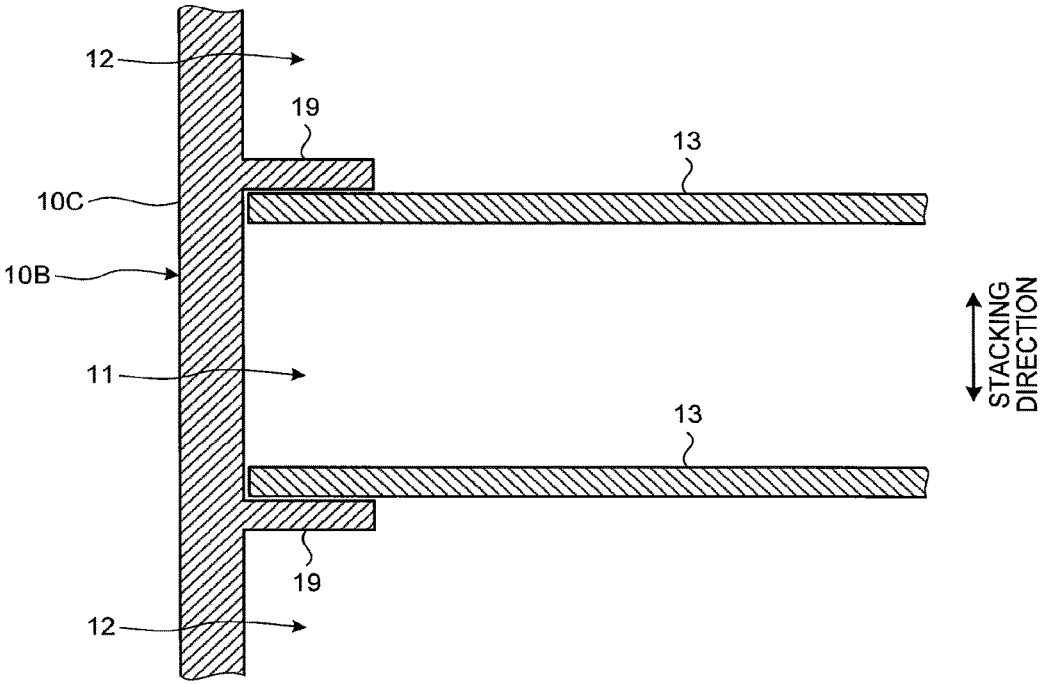
FIG. 12 is a diagram illustrating an exemplary structure according to a first modified example of the embodiment.

Meanwhile, a following structure may be used as a means to increase the decrease rate of the cross-sectional area ΔAo of the first flow passage 11 larger than the decrease rate of the cross-sectional area ΔAw of the second flow passage 12. FIG. 12 is a diagram illustrating an exemplary structure according to the first modified example of the embodiment. As illustrated in FIG. 12, the heat exchanger main body 10B includes a wall portion 10C. The wall portion 10C includes a support portion 19. The support portion 19 projects from an inner surface of the wall portion 10C to the second flow passage 12. The support portion 19 is connected to a surface on the second flow passage 12 side of the separator 13, and supports the separator 13 from the second flow passage 12 side. With this structure, in the case where the separator 13 thermally expands, expansion to the inside of the first flow passage 11 is allowed and expansion to the second flow passage 12 side is restricted or suppressed.

A Young's modulus of the first fin 14 may be set smaller than a Young's modulus of the second fin 15 as a means to increase the decrease rate of the cross-sectional area ΔAo of the first flow passage 11 larger than the decrease rate of the cross-sectional area ΔAw of the second flow passage 12. By this, when the separator 13 expands, the separator 13 can easily expand to the first flow passage 11 side.

Further, rigidity of the first fin 14 may be made smaller than rigidity of the second fin 15. For example, the decrease rate of the cross-sectional area ΔAo of the first flow passage 11 can be increased larger than the decrease rate of the cross-sectional area ΔAw of the second flow passage 12 by increasing the thickness of the first fin 14 larger than the thickness of the second fin 15.

Further, the decrease rate of the cross-sectional area ΔAo of the first flow passage 11 can be increased larger than the decrease rate of the cross-sectional area ΔAw of the second flow passage 12 by reducing the height H1 of the first flow passage 11 in the low temperature range (refer to FIG. 7) shorter than the height H3 of the second flow passage 12 in the low temperature range. By this, even though an expansion amount to the first flow passage 11 side is same as an expansion amount to the second flow passage 12 side when the separator 13 expands in the high temperature range, the decrease rate of the cross-sectional area ΔAo of the first flow passage 11 becomes larger than the decrease rate of the cross-sectional area ΔAw of the second flow passage 12.

The cross-sectional area adjuster may increase the decrease rate of the cross-sectional area ΔAo of the first flow passage 11 larger than the decrease rate of the cross-sectional area ΔAw of the second flow passage 12 by changing the flow passage cross-sectional area of the first flow passage 11 instead of changing the flow passage cross-sectional areas of both the first flow passage 11 and the second flow passage 12.

As described above, the cross-sectional area adjuster according to the first modified example of the embodiment increases a value of the decrease rate of the cross-sectional area ΔAo of the first flow passage 11 larger than a value of the decrease rate of the cross-sectional area ΔAw of the second flow passage 12. By providing a difference in the decrease rate ΔA of the cross-sectional area in accordance with the decrease rate Δν of the kinetic viscosity of the liquid flowing in the respective flow passages 11, 12, it is possible to achieve both increase of the heat exchange amount in the heat exchanger 1 and reduction of the pressure loss according to characteristics of the respective liquid.

Second Modified Example of Embodiment

According to the above-described embodiment, the first fin 14, second fin 15, and separator 13 as the cross-sectional area adjusters are continuously thermally deformed in accordance with the linear expansion coefficient. Instead, a deform amount of the cross-sectional area adjuster may be discontinuously changed at a predetermined boundary temperature. As an example of such a cross-sectional area adjuster is the one formed of shape memory alloy. For example, the first fin 14, second fin 15, and separator 13 are formed of the shape memory alloy that is deformed (restored) in a predetermined shape when the temperature reaches the boundary temperature. The deformed fins 14, 15 and separator 13 expand larger than the fins 14, 15 and separator 13 before deformation. The boundary temperature at which the shape memory alloy is deformed is a temperature between the low temperature range and the high temperature range. For example, the boundary temperature is suitably set based on a correspondence relation between the temperature and the kinetic viscosity of oils 4, 5.

The orifice 17 disposed in the bypass flow passage 16 may be discontinuously deformed at the predetermined boundary temperature instead of continuously thermally being deformed in accordance with the linear expansion coefficient. The orifice 17 may be formed of, for example, shape memory alloy. The area of the hole 17*a* of the orifice 17 that has been deformed at the boundary temperature is smaller than the area of the hole 17*a* before deformation.

A control device to change an opening area of the orifice 17 may be provided as well. The control device includes, for example, a movable blocking member capable of blocking at least a part of the hole 17*a* of the orifice 17. The control device changes the opening area of the orifice 17 by the blocking member based on a detection result of the T/M oil temperature in the bypass flow passage 16.

The contents disclosed in the above-described embodiment and modified examples can be suitably combined for implementation.

The above-described heat exchanger can suppress pressure loss by increasing the flow passage cross-sectional area in the low temperature range, and can increase the heat exchange amount by reducing the flow passage cross-sectional area in the high temperature range to increase a flow speed.

The above-described heat exchanger can achieve both increase of the heat exchange amount and reduction of the pressure loss by providing a difference in a decrease rate of the cross-sectional area in accordance with a decrease rate of the kinetic viscosity of the liquid flowing in the first flow passage and the second flow passage.

In the above-described heat exchanger, the pressure loss in the first flow passage can be suppressed by the second cross-sectional area adjuster that facilitates flow of the first liquid in the bypass flow passage at the time of low temperature, and the heat exchange amount is increased by increasing the flow rate of the first flow passage at the time of high temperature.

The above-described heat exchanger is capable of largely changing the flow passage cross-sectional area in response to temperature change by the fin having a large thermal expansion coefficient.

The cross-sectional area adjuster of the heat exchanger according to the present invention increases a value of the flow passage cross-sectional area in the low temperature range larger than a value of the flow passage cross-sectional area in the high temperature range. The heat exchanger according to the present invention provides an effect of achieving both increase of the heat exchange amount and reduction of the pressure loss.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A heat exchanger, comprising:

a first flow passage where first liquid flows;

a second flow passage where second liquid flows, the first flow passage being separated from the second flow passage by a separator; and a heat exchanger main body configured to exchange heat between the first liquid and the second liquid, the heat exchanger main body including a cross-sectional area adjuster configured to change a flow passage cross-sectional area of each of the first flow passage and the second flow passage by thermal deformation, the cross-sectional area adjuster adjusting a value of the flow passage cross-sectional area in a low temperature range to be larger than a value of the flow passage cross-sectional area in a high temperature range, wherein the cross-sectional area adjuster includes a first fin in the first flow passage and the first fin is connected to the separator and to a wall of the first flow passage opposite to the separator, the cross-sectional area adjuster includes a second fin in the second flow passage and the second fin is connected to the separator and to a wall of the second flow passage opposite to the separator, a decrease rate of kinetic viscosity, which is a decrease rate of a value of kinetic viscosity in a high temperature range relative to a value of kinetic viscosity in the low temperature range, of the second liquid is smaller than a decrease rate of kinetic viscosity of the first liquid, and the cross-sectional area adjuster adjusts a value of a decrease rate of the cross-sectional area, which is a decrease rate of the flow passage cross-sectional area in the high temperature range relative to the flow passage cross-sectional area in the low temperature range, of the first flow passage to be larger than a value of a decrease rate of the cross-sectional area of the second flow passage.

2. The heat exchanger according to claim 1, further comprising:

a bypass flow passage configured to flow the first liquid by bypassing the first flow passage; and a second cross-sectional area adjuster provided at the bypass flow passage, and configured to adjust a flow passage cross-sectional area of the bypass flow passage in the high temperature range to be smaller than a flow passage cross-sectional area of the bypass flow passage in the low temperature range.

3. The heat exchanger according to claim 1, wherein at least one of the first fin and the second fin contains mercury or polyethylene as a material.

4. The heat exchanger according to claim 1, wherein the cross-sectional area adjuster is configured to change the flow passage cross-sectional area of the first flow passage and the second flow passage by thermal deformation.

5. The heat exchanger according to claim 1, wherein a flow direction of the first flow passage is orthogonal to a direction of the second flow passage.

6. The heat exchanger according to claim 1, wherein the separator is a partitioning member that exchanges heat between the first flow passage and the second flow passage.

* * * * *